US007862488B2

(12) United States Patent
Albanese

(10) Patent No.: US 7,862,488 B2
(45) Date of Patent: Jan. 4, 2011

(54) WEIGHTABLE HOOP BELT SYSTEM

(76) Inventor: Alison Albanese, 236 Fremont St., Apt 2F, Harrison, NY (US) 10528

( * ) Notice: Subject to any disclaimer, the term of this patent is extended or adjusted under 35 U.S.C. 154(b) by 0 days.

(21) Appl. No.: 12/472,435

(22) Filed: May 27, 2009

(65) Prior Publication Data

US 2009/0270232 A1 Oct. 29, 2009

Related U.S. Application Data

(63) Continuation-in-part of application No. 11/738,209, filed on Apr. 20, 2007, now abandoned.

(51) Int. Cl.
*A63B 21/22* (2006.01)
*A63B 21/065* (2006.01)
*A63H 1/00* (2006.01)

(52) U.S. Cl. ..... 482/110; 482/105; 446/236

(58) Field of Classification Search ..... 482/131, 482/122, 124, 135–139, 92–93, 105, 110
See application file for complete search history.

(56) References Cited

U.S. PATENT DOCUMENTS 489,394 A * 1/1893 Spencer ..... 273/109
1,259,889 A * 3/1918 Macdonald ..... 446/409
1,529,851 A * 3/1925 Smithson ..... 473/514
1,714,433 A * 5/1929 Molnar ..... 463/69
1,955,330 A * 4/1934 Hiers et al. ..... 446/431
2,509,810 A * 5/1950 Core, Jr. ..... 482/108
2,547,886 A * 4/1951 Poux ..... 607/112
2,644,270 A * 7/1953 Marong ..... 446/170
2,941,219 A * 6/1960 Irving ..... 441/56
2,946,152 A * 7/1960 Rubin ..... 446/265
3,135,512 A * 6/1964 Taylor ..... 273/109
3,211,457 A * 10/1965 Dreyer ..... 273/115
3,493,228 A * 2/1970 Hicks et al. ..... 472/134
3,509,660 A * 5/1970 Seymour ..... 446/38
3,556,522 A * 1/1971 Gale ..... 472/116
3,654,980 A * 4/1972 Rosen et al. ..... 116/308
3,655,197 A * 4/1972 Milbaum ..... 273/146
3,659,849 A * 5/1972 Seymour ..... 473/514
3,756,592 A * 9/1973 Johnson ..... 482/110
3,823,942 A * 7/1974 Duncan ..... 473/514
3,843,117 A * 10/1974 Johnson ..... 482/110
3,887,185 A * 6/1975 Landreville ..... 273/109
3,889,308 A * 6/1975 Persson ..... 441/56
3,892,084 A * 7/1975 Hanysz ..... 446/411
3,995,855 A * 12/1976 Schultz ..... 473/594

(Continued)

OTHER PUBLICATIONS

Custom weighted hoops—http://www.customhoop.com, see attached pdf.*

*Primary Examiner*—Steve R Crow
*Assistant Examiner*—Robert F Long
(74) *Attorney, Agent, or Firm*—Michael A. Blake

(57) ABSTRACT

A weightable hoop system comprising: a single bodied molded hoop with a top and a bottom comprising: a first annular volume located at the top; a second annular volume located at the bottom; a pinch seal located between the first annular volume and the second annular volume, and preventing fluid communication between the first annular volume and the second annular volume; a first threaded input member in fluid communication with the first annular volume; and a second threaded input member in fluid communication with the first annular volume.

7 Claims, 5 Drawing Sheets

U.S. PATENT DOCUMENTS 4,014,545 A * 3/1977 Keim ..... 473/465
4,052,982 A * 10/1977 Ozeryansky ..... 601/121
4,063,382 A * 12/1977 McCallum ..... 446/48
4,148,479 A * 4/1979 Spector ..... 482/112
4,211,032 A * 7/1980 Robinett ..... 446/453
4,215,510 A * 8/1980 Worrell ..... 446/28
4,218,057 A * 8/1980 Wilson ..... 482/93
4,257,651 A * 3/1981 Griffith, Jr. ..... 301/58
D263,416 S * 3/1982 Saire et al. ..... D24/206
4,356,915 A * 11/1982 Phillips ..... 206/315.1
4,378,113 A * 3/1983 Piccini ..... 482/110
4,448,418 A * 5/1984 McNeill ..... 273/123 A
4,538,806 A * 9/1985 Wilkerson ..... 482/108
4,659,078 A * 4/1987 Blome ..... 482/110
4,687,210 A * 8/1987 Michel ..... 473/589
4,722,299 A * 2/1988 Mohr ..... 119/707
4,756,530 A * 7/1988 Karman ..... 273/113
4,828,256 A * 5/1989 Lee ..... 482/106
4,897,069 A * 1/1990 Overturf ..... 446/219
4,915,661 A * 4/1990 Getgey ..... 446/48
4,931,333 A * 6/1990 Henry ..... 428/76
5,069,208 A * 12/1991 Noppel et al. ..... 607/114
5,114,371 A * 5/1992 Alonzo ..... 441/129
5,139,014 A * 8/1992 Chang ..... 601/118
5,237,903 A * 8/1993 Bein et al. ..... 84/404
5,244,445 A * 9/1993 Amesquita ..... 482/110
5,393,285 A * 2/1995 Fischer et al. ..... 482/108
D359,822 S * 6/1995 McCance ..... D30/160
5,431,615 A * 7/1995 Correll ..... 482/108
5,476,408 A * 12/1995 Hoeting et al. ..... 446/419
5,492,526 A * 2/1996 Chen ..... 601/132
5,569,134 A * 10/1996 Nordanger ..... 482/110
5,572,955 A * 11/1996 Boshears ..... 119/706
5,575,738 A * 11/1996 Millington et al. ..... 482/35
5,611,721 A * 3/1997 Hoeting et al. ..... 446/419
5,813,946 A * 9/1998 Lin et al. ..... 482/27
5,820,531 A * 10/1998 Choi ..... 482/93
5,925,072 A * 7/1999 Cramer et al. ..... 607/108
5,950,608 A * 9/1999 Tidman ..... 124/6
6,068,580 A * 5/2000 Myers et al. ..... 482/93
6,074,413 A * 6/2000 Davis et al. ..... 607/108
6,165,040 A * 12/2000 Burich ..... 446/242
6,190,292 B1 * 2/2001 Panes ..... 482/93
D445,463 S * 7/2001 Seo ..... D21/457
6,347,973 B1 * 2/2002 Grant et al. ..... 446/450
6,431,939 B1 * 8/2002 Roh et al. ..... 446/236
6,450,854 B1 * 9/2002 Fireman et al. ..... 446/236
6,482,136 B1 * 11/2002 Kessler ..... 482/110
6,647,741 B2 * 11/2003 Pechous et al. ..... 62/457.6
6,814,645 B2 * 11/2004 Kuk ..... 446/236
6,926,276 B1 * 8/2005 Zocchi ..... 273/146
6,966,814 B2 * 11/2005 Mendel ..... 446/236
7,056,269 B2 * 6/2006 Cleveland et al. ..... 482/148
7,285,080 B1 * 10/2007 Chiu ..... 482/142
D556,841 S * 12/2007 Oates ..... D21/679
D566,205 S * 4/2008 Oates ..... D21/662
7,470,845 B2 * 12/2008 Fermie et al. ..... 84/402
2003/0228829 A1 * 12/2003 Falk ..... 446/475
2005/0070202 A1 * 3/2005 Mendel ..... 446/236
2006/0084512 A1 * 4/2006 Cohen ..... 472/57
2006/0240741 A1 * 10/2006 Kessler ..... 446/236
2008/0261785 A1 * 10/2008 Albanese ..... 482/93
2009/0270232 A1 * 10/2009 Albanese ..... 482/105

* cited by examiner

WEIGHTABLE HOOP BELT SYSTEM

CROSS-REFERENCES

This application is a continuation-in-part application of U.S. Ser. No. 11/738,209, filed Apr. 20, 2007 now abandoned, to Alison Albanese, entitled "Weightable Hoop Belt System", the contents of which are fully incorporated by reference herein.

TECHNICAL FIELD

The present invention relates to play and/or exercise hoops and a waist protecting belt.

BACKGROUND

Play hoops, such as but not limited to the HULA HOOP type, are widely known. They are used for rolling and gyrating the hoop about the hips and other parts of the body. Such hoops are typically made from a length of plastic tubing by bending the length into a circle and joining the ends together. Such hoops have been found to be useful for exercise. Gyrating a conventional hoop about the hips requires considerable work because the needed rotational speed is quite high, thus many calories may be burned while gyrating a hoop about one's person.

A drawback of known hoops is that they are often too light to maximize caloric expenditure. Conventional hoops can be made of heavier-walled plastic tubing, but this is expensive and can make for difficulty in bending the tubing into the required circular form. Additionally, if heavier hoops are used, the mass of the hoop may cause discomfort to the user as the hoop rotates around the user.

Some known hoops allow for filling with water or other liquid to add weight to the hoop. However, there are often leakage problems with these types of hoops.

Thus, there is a need for a hoop system that addresses these and other problems associated with currently available hoops.

SUMMARY

The disclosed invention relates to a weightable hoop system comprising: a single bodied molded hoop comprising: a first annular volume; a second annular volume located adjacent to the first annular volume; a third annular volume located adjacent to the first annular volume; a threaded input member in fluid communication with the first annular volume; and where the first annular volume is not in fluid communication with the second annular volume and the third annular volume, and the second annular volume is not in fluid communication with the third annular volume.

The disclosed invention also relates to a weightable hoop system comprising: an outer single bodied molded hoop comprising: an outer surface; an inner surface; an upper groove located on the outer surface; a lower groove located on the outer surface; a first annular volume that is not in communication with the ambient atmosphere; an inner single bodied molded hoop comprising: a first end and a second end, such that the inner single bodied molded hoop is not a continuous ring; a top; a bottom; a second generally annular volume; a threaded input member in fluid communication with the second annular volume; a first flange located at the top; a second flange located at the bottom; and where the first flange and second flange are configured to attach to the upper groove and lower groove respectively via an interference fit.

In addition, the disclosed invention relates to a weightable hoop system comprising: a single bodied molded hoop with a top and a bottom comprising: a first annular volume located at the top; a second annular volume located at the bottom; a pinch seal located between the first annular volume and the second annular volume, and preventing fluid communication between the first annular volume and the second annular volume; a first threaded input member in fluid communication with the first annular volume; and a second threaded input member in fluid communication with the first annular volume.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
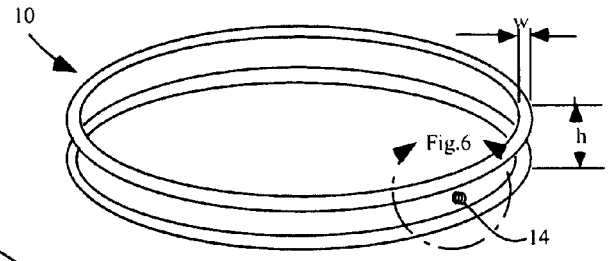
FIG. 1 is perspective view of a first disclosed embodiment of a weightable hoop.
Figure 2:
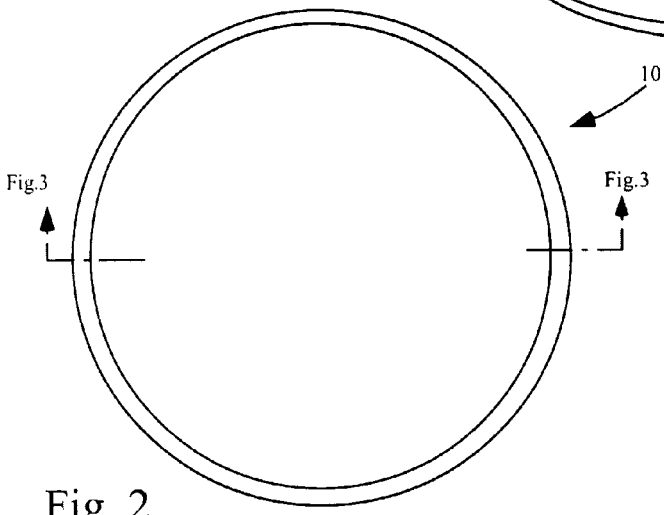
FIG. 2 is a top view of the weightable hoop from FIG. 1.
Figure 3:
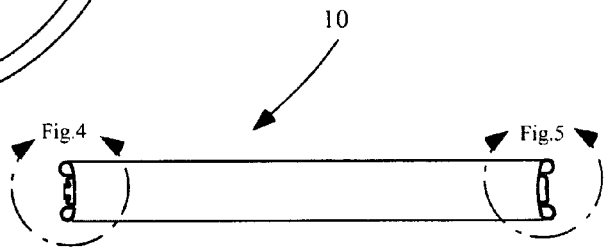
FIG. 3 is a cross-sectional view of the weightable hoop from FIG. 2.
Figure 4:
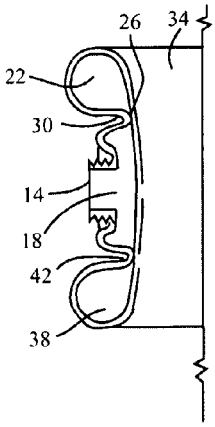
FIG. 4 is a detail view of one end of the cross-sectional view of the weightable hoop from FIG. 3.
Figure 5:
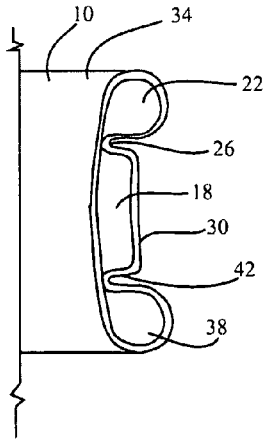
FIG. 5 is a detail view of another end of the cross-sectional view of the weightable hoop from FIG. 3.
Figure 6:
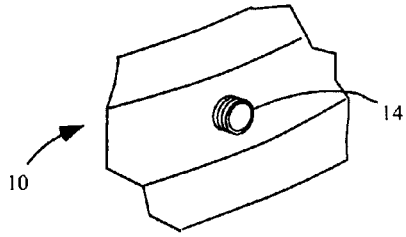
FIG. 6 is a detail perspective view of the threaded input member.

FIG. 1 is a perspective view of one embodiment of the disclosed weightable hoop 10. In this embodiment, the hoop 10 comprises a single molded hoop. FIG. 2 is a top view of the disclosed weightable hoop 10. FIG. 3 is a cross-sectional side view of the hoop 10. FIGS. 4 and 5 are detail views of the cross-sections B and C respectively from FIG. 3. Referring to FIG. 4, a threaded input member 14 is in fluid communication with a first annular volume 18. The threaded input member 14 is configured to removeably attach to a threaded cap, which seals the first annular volume 18 from the ambient atmosphere. A second annular volume 22 is not in fluid communication with the first annular volume 18 due to a first pinch seal 26 comprising the outer surface 30 of the hoop and an inner surface 34 of the hoop. A third annular volume 38 is not in fluid communication with the first annular volume 18 due to a second pinch seal 42 comprising the outer surface 30 of the hoop and an inner surface 34 of the hoop. FIG. 6 is a perspective detail view D of the threaded input member 14 from FIG. 1. In other embodiments, the threaded input member 14 may be a simple input member without threads, configured to be fitted with a plug to seal the first hoop volume 18 from the ambient atmosphere. The first annular volume 18, may be generally empty, except for atmospheric air. The second annular volume 22 and third annular volume 38 may also be generally empty, except for atmospheric air. A user may fill the first annular volume with a fluid such as but not limited to water, or a granular material such as but not limited to sand. Fluid or granular material may be placed inside the first annular volume 18 by removing the threaded cap, and filling the first annular volume 18 via the threaded input member 14. In addition, a user may completely fill the first annular volume 18 with fluid or a granular material. Of course, one will recognized that the user may fill the first annular volume 18 so that it is approximately half way filled. Still one will recognize that the amount of fluid or granular material placed in the first annular volume may be infinitely varied by an end user, such that the first annular volume 18 may be completely filled, or empty, or any amount (of fluid or granular material) between being completely filled and empty may be placed in the first annular volume 18.

Figure 7:
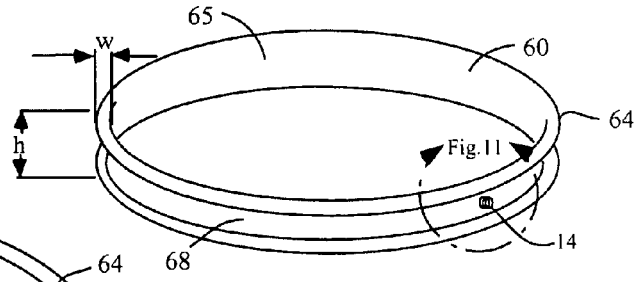
FIG. 7 is perspective view of a second embodiment of the disclosed weightable hoop.
Figure 8:
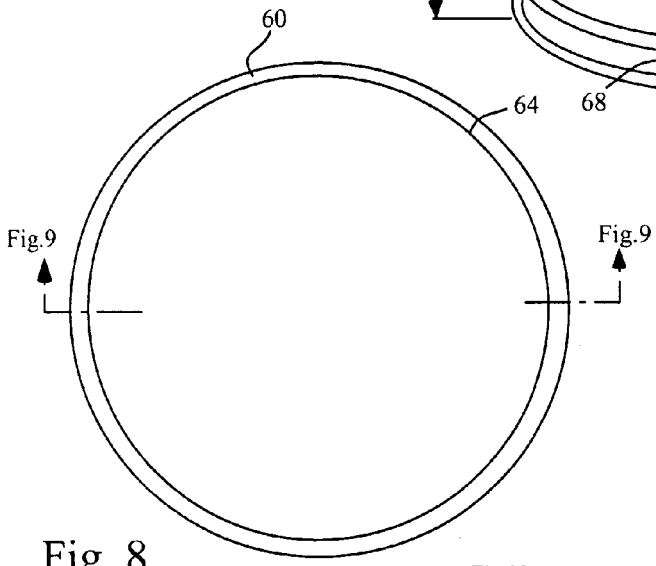
FIG. 8 is a top view of the weightable hoop from FIG. 7.
Figure 9:
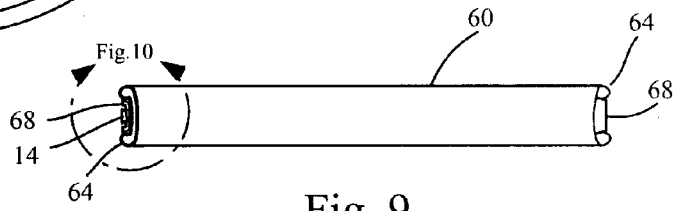
FIG. 9 is a cross-sectional view of the weightable hoop from FIG. 8.
Figure 10:
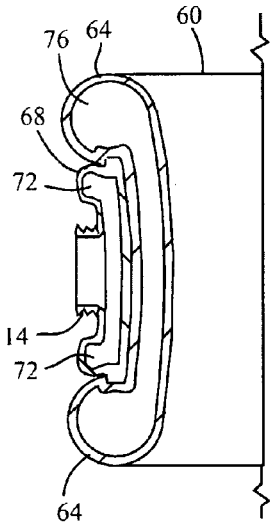
FIG. 10 is a detail view of one end of the weightable hoop from FIG. 9.
Figure 11:
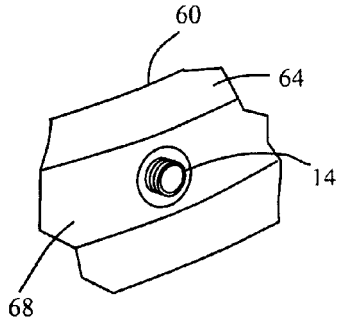
FIG. 11 is a detail perspective view of the threaded input member.

FIG. 7 shows another embodiment of the disclosed weightable hoop 60. The hoop 60 comprises an outer molded hoop 64 coupled to an inner molded hoop 68. A threaded input member 14 is in fluid communication with the internal annular volume 72 (shown in FIG. 10) of the inner hoop 68. FIG. 8 is a top view of the disclosed weightable hoop 60. FIG. 9 is a cross-sectional view of the hoop 60. FIG. 10 is a detail of one end of the cross-sectioned hoop 60. In this view the internal annular volume 72 of the inner hoop 68 is plainly visible. The internal annular volume 72 is not in communication with the internal annular volume 76 of the outer hoop 64. FIG. 11 is a detailed view showing a perspective view of the threaded input member 14 located on the inner hoop 68. The internal annular volume 72, may be generally empty, except for atmospheric air. The internal annular volume 76 may also be generally empty, except for atmospheric air. A user may fill the internal annular volume 72 with a fluid such as but not limited to water, or a granular material such as but not limited to sand. Fluid or granular material may be placed inside the internal annular volume 72 by removing the threaded cap, and filling the internal annular volume 72 via the threaded input member 14. In addition, a user may completely fill the internal annular volume 72 with fluid or a granular material. Of course, one will recognized that the user may fill the internal annular volume 72 so that it is approximately half way filled. Still one will recognize that the amount of fluid or granular material placed in the internal annular volume 72 may be infinitely varied by an end user, such that the internal annular volume 72 may be completely filled, or empty, or any amount (of fluid or granular material) between being completely filled and empty may be placed in the internal annular volume 72.

Figure 12:
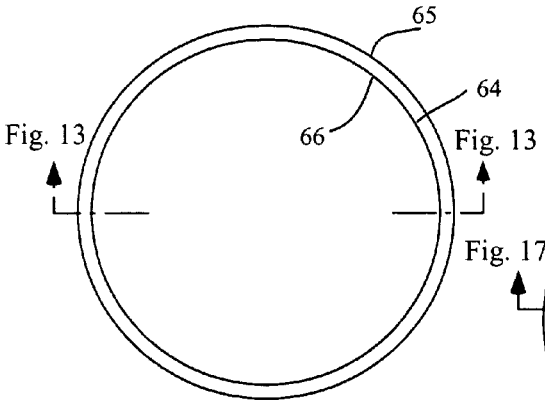
FIG. 12 is a top view of the outer hoop.
Figure 15:
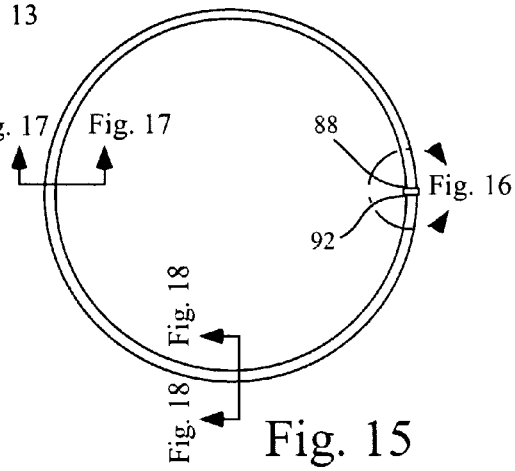
FIG. 15 is a top view of the inner hoop.
Figure 13:
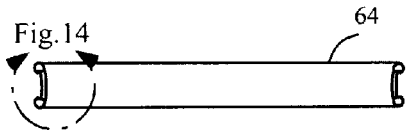
FIG. 13 is a cross-sectional view of the outer hoop.
Figure 14:
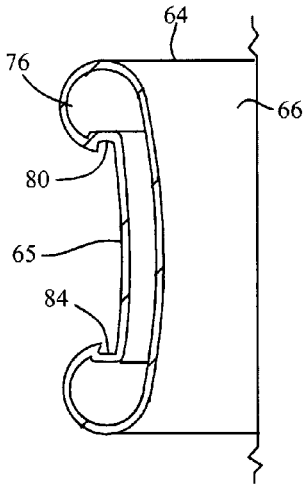
FIG. 14 is a detail view of one end of the cross-sectional view from FIG. 13.
Figure 16:
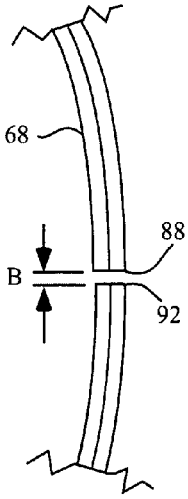
FIG. 16 is a detail view of the inner hoop from FIG. 15.
Figure 17:
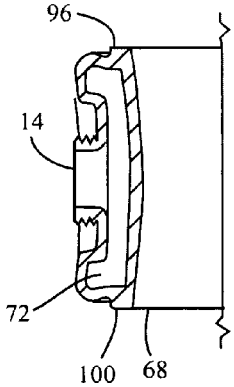
FIG. 17 is a partial cross-sectional view of the inner hoop from FIG. 15.
Figure 18:
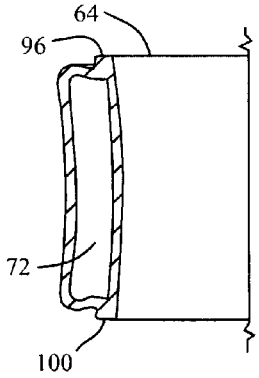
FIG. 18 is a partial cross-sectional view of the inner hoop from FIG. 15.

FIG. 12 shows a top view of the outer hoop 64. FIG. 13 shows a cross-sectional view of the outer hoop 64. FIG. 14 shows a detail view of one end of the outer hoop 64 from the cross-sectional view from FIG. 13. An upper groove 80 and a lower groove 84 are located on the outer surface 65 of the outer hoop 64. The inner surface 66 of the outer hoop 64 is the surface that contacts a user, as the user rotates the hoop 64 about his body in a typical hula hoop motion. The upper groove 80 and lower groove 84 are configured to be attachable to the inner hoop 68 via an interference fit. FIG. 15 is a top view of the inner hoop 68. As can be seen in this view, the inner hoop 68 is not a continuous loop, but rather has a first end 88 and a second end 92. These two ends can be seen more clearly in FIG. 16 which is a detailed view from FIG. 15. The space M between the two ends may be from about 1/16 of an inch to about 1 inch. FIG. 17 is a close up cross-sectional view of the inner hoop 68 through the threaded input member 14. In this view, a first flange 96 and a second flange 100 are located on the top and bottom of the inner hoop 68, respectively. The inner hoop 68, is configured to snap into the outer hoop 64, via the flanges 96, 100 communicating with the upper groove 80 and lower groove 84 respectively, by an interference fit. Because the hoops are made out of a material such as HD polyethylene, polyethylene, and/or polypropylene, and because the inner hoop 68 has a space M between its two ends 88,92, the inner hoop 68 can be elastically bent and fixed within the outer hoop 64. FIG. 18 is a cross-sectional view of the inner hoop 68 through plane M-M.

Figure 19:
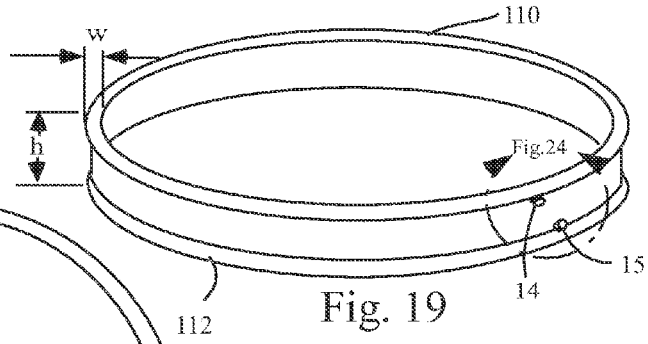
FIG. 19 is a perspective view of a third disclosed embodiment of the weightable hoop.
Figure 20:
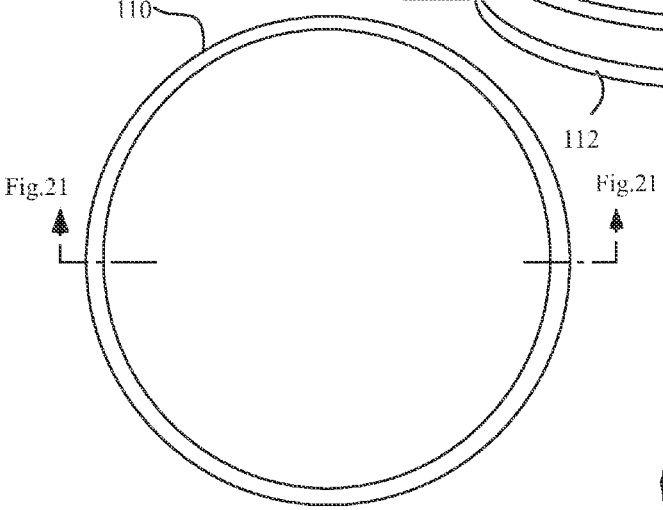
FIG. 20 is a top view of the hoop from FIG. 19.
Figure 26:
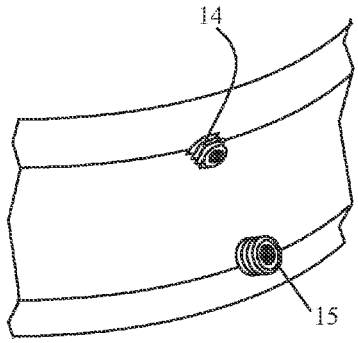
FIG. 26 is a close-up perspective view of the hoop from FIG. 19.
Figure 21:
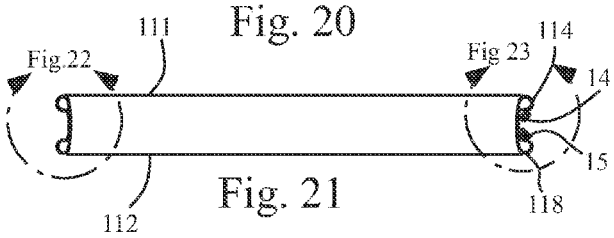
FIG. 21 is a cross-sectional view of the hoop from FIG. 20.
Figure 22:
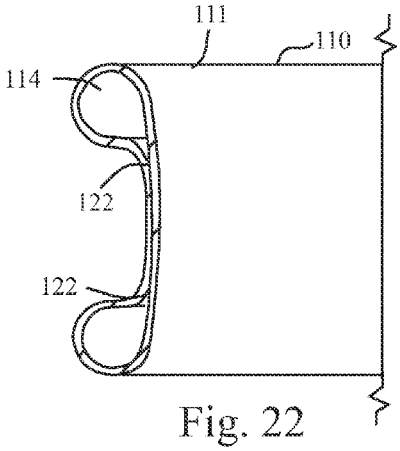
FIG. 22 is a detail view of one end of the hoop from the cross-sectional view of FIG. 21.
Figure 23:
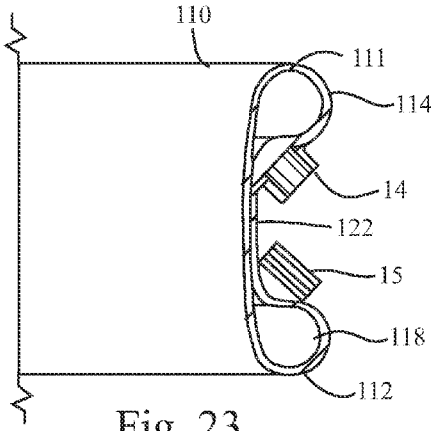
FIG. 23 is a detail view of another end of the hoop from the cross-sectional view of FIG. 21.

FIG. 19 shows a perspective view of another embodiment of a disclosed weightable hoop 110. This hoop 110 comprises one molded hoop structure. In communication with a first inner annular volume 114 (shown in FIGS. 21-23) of the hoop 110 is a first threaded input member 14. In communication with a second inner annular volume 118 (shown in FIGS. 21-23) is a second threaded input member 15. FIG. 20 is a top view of the disclosed weightable hoop 110. FIG. 21 is a cross-sectional view of the disclosed weightable hoop 110. FIG. 22 is a detail view of one side of the cross-sectional view of the disclosed weightable hoop 110. In this view, the first inner annular volume 114 and second inner annular volume 118 are clearly seen. The two annular volumes 114, 118 are not in fluid communication with each other, but rather, are sealed from each by a pinch seal 122 made in the material that forms the hoop 110. The first annual volume 114 is located at the top 111 of the hoop 110, and the second annular volume 118 is located at the bottom 112 of the hoop 110. FIG. 23 is a detail view of another side of the cross-sectional view of the disclosed weightable hoop 110. In this view, it can be clearly seen that the first threaded input member 14 is in fluid communication with the first inner annular volume 114. Likewise, it can be clearly seen that the second threaded input member 15 is in fluid communication with the second inner annular volume 118. The first inner annular volume 114 and second inner annular volume 118 may be generally empty, except for atmospheric air. A user may fill the first inner annular volume 114 and/or the second inner annular volume 118 with a fluid such as but not limited to water, or a granular material such as but not limited to sand. Fluid or granular material may be placed inside the first inner annular volume 114 by removing the threaded cap, and filling the first inner annular volume 114 via the threaded input member 14. In addition, a user may completely fill the first inner annular volume 114 with fluid or a granular material. Of course, one will recognized that the user may fill the first inner annular volume 114 so that it is approximately half way filled. Still one will recognize that the amount of fluid or granular material placed in the first inner annular volume 114 may be infinitely varied by an end user, such that the first inner annular volume 114 may be completely filled, or empty, or any amount (of fluid or granular material) between being completely filled and empty may be placed in the first inner annular volume 114. Similarly, fluid or granular material may be placed inside the second inner annular volume 118 by removing the threaded cap, and filling the second inner annular volume 118 via the threaded input member 15. In addition, a user may completely fill the second inner annular volume 118 with fluid or a granular material. Of course, one will recognized that the user may fill the second inner annular volume 118 so that it is approximately half way filled. Still one will recognize that the amount of fluid or granular material placed in the second inner annular volume 118 may be infinitely varied by an end user, such that the second inner annular volume 118 may be completely filled, or empty, or any amount (of fluid or granular material) between being completely filled and empty may be placed in the second inner annular volume 118.

The disclosed hoop embodiments may be manufactured through blow molding or rotational molding techniques, thus avoiding the need to couple a tube at either end in order to form a hoop, thus avoiding leakage problems at the coupling. Thus, the first disclosed embodiment and third disclosed embodiments are single bodied molded hoops. The second disclosed embodiment, is a two bodied molded hoop. The embodiments disclosed with respect to FIGS. 1-18, allow liquid to be placed in a centrally located annular volume, thus providing better and more equal weight distribution to the hoop when in use. The disclosed weightable hoop may have a diameter of about 36.5 inches, of course larger and smaller hoops may be made for different sized people. The hoops may have a height, h, of about 4.5 inches, and a width, w, of about 1.3 inches. Of course these dimensions may be increased or decreased for different sized people, and different uses.

Figure 25:
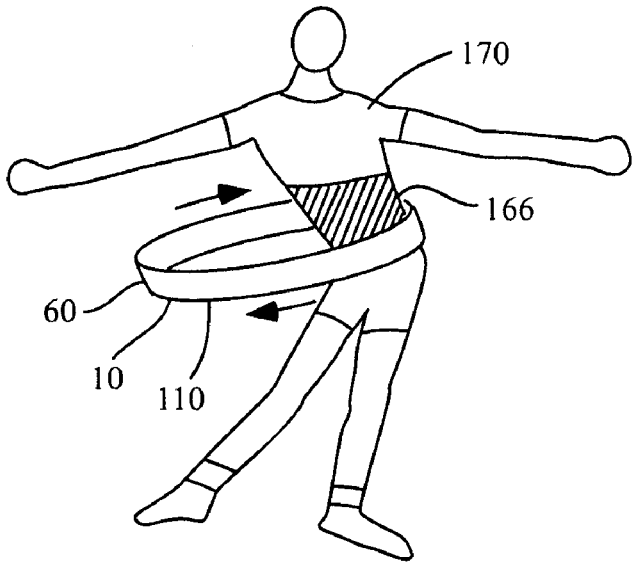
FIG. 25 is a front view showing the user using the hoop with the belt.
Figure 24:
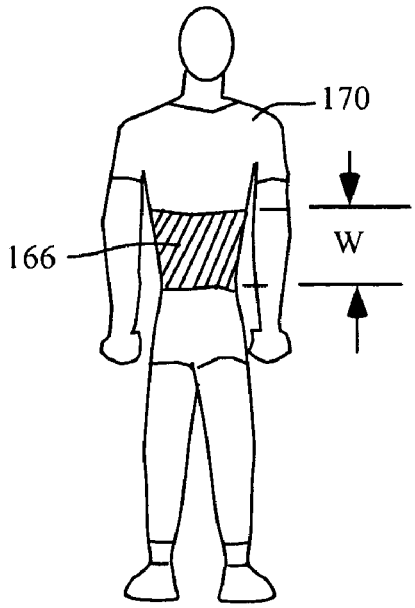
FIG. 24 is a front view showing a user wearing the disclosed belt.

FIG. 24 shows a belt 166 being worn by a user 170 of the weightable hoop and belt system. The belt 166 is a padded belt that is configured to fit under a person's chest and to his or her waist. The belt will typically have a width "W" of about 14 inches to about 17 inches. Although for taller, or shorter people, different widths may be used. The belt 166 is also padded, to provide cushioning. The padding may come from making the belt out of a soft material such as ¼ inch neoprene. However, thicker or thinner neoprene may be used, as well as other soft, cushioning material. The belt may have a Velcro closure to allow it to fit a wide range of people. FIG. 25 shows a user 170 using the weightable hoop and belt system, that is the user is moving the hoop in a "hula hoop" manner about his torso, while protecting his body with the belt 166. The belt 166 may be used with any of the embodiments of the weightable hoop 10, 60, 110 disclosed.

The disclosed weightable hoop and belt system has many advantages. The disclosed hoops can provide internal inertia shifting that is accomplished by partially filling the hollow tubular hoops with fluid or a granular material. The trapped fluid or granular material increases the mass, provides internal damping of any motion (especially axial acceleration or deceleration), and leads to novel motions because of the shifting of the water inside. Weight (that is, fluid or granular material) can be added to or removed from the hoops dependent on the user's comfort and/or fitness level. Fluid or granular material can be easily added and/or removed to and from the hoops. The amount of fluid or granular material added or removed from the hoops may be infinitely adjusted by an end user between having the annular volume(s) empty or completely filled. The belt provides cushioning to the user when using the hoops, and prevents discomforts. The belt also keeps the torso warm, and prevents the development of a pulled muscle in the torso. The weightable hoop may be covered in a soft material, such as neoprene.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A weightable hula hoop system comprising:

a single bodied molded hoop comprising:

a first annular volume, the first annular volume being generally empty, and fillable with an infinitely variable amount of a material between the limits of being completely filled and being completely empty;

a second annular volume located adjacent to the first annular volume, the second annular volume being generally empty;

a first pinch seal separating the first annular volume from the second annular volume, the first pinch seal located along generally the entire circumference of the first and second annual volumes;

a third annular volume located adjacent to the first annular volume, the third annular volume being generally empty;

a second pinch seal separating the first annular volume from the third annular volume, the second pinch seal located generally along generally the entire circumference of the first and third annual volumes;

a threaded input member in fluid communication with the first annular volume, and configured to allow one to vary the amount of weighted material within the first annular volume; and wherein the first annular volume is not in fluid communication with the second annular volume and the third annular volume, and the second annular volume is not in fluid communication with the third annular volume; and wherein the single bodied molded hoop is generally made out of a plastic and configured to be gyrated about one's body as a weightable hula hoop, and sized to fit one's body such that one can twirl the single bodied molded hoop about one's body.

2. The weightable hoop system of claim 1 further comprising:

a threaded cap configured to thread onto the threaded input member, thereby sealing the first annular volume from the ambient atmosphere.

3. The weightable hoop system of claim 1, further comprising a padded belt to be worn by a user, the belt being of a width that extends generally from the user's waist to the user's chest.

4. The weightable hoop system of claim 3, wherein the padded belt is made out of neoprene.

5. The weightable hoop system of claim 1, wherein the material is a fluid.

6. The weightable hoop system of claim 1, wherein the material is a granular material.

7. The weightable hoop system of claim 1, wherein the material is liquid water.

* * * * *